US007461620B2

(12) United States Patent
Hara

(10) Patent No.: US 7,461,620 B2
(45) **Date of Patent: *Dec. 9, 2008**

(54) VARIABLE VALVE ACTUATION DEVICE OF INTERNAL COMBUSTION ENGINE

(75) Inventor: Seinosuke Hara, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 8 days.

This patent is subject to a terminal disclaimer.

(21) Appl. No.: 11/653,877

(22) Filed: Jan. 17, 2007

(65) Prior Publication Data

US 2007/0113810 A1 May 24, 2007

Related U.S. Application Data

(63) Continuation of application No. 11/213,916, filed on Aug. 30, 2005, now Pat. No. 7,188,595.

(30) Foreign Application Priority Data

Aug. 31, 2004 (JP) ..... 2004-252257

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.2, 90.39, 90.44, 90.31, 90.27; 74/569, 74/559, 567
See application file for complete search history.

(56) References Cited

U.S. PATENT DOCUMENTS

| | | | | |
|---|---|---|---|---|
| 5,373,818 | A | 12/1994 | Unger | |
| 6,659,053 | B1 | 12/2003 | Cecur | |
| 6,837,198 | B2 * | 1/2005 | Maas et al. | 123/90.16 |
| 7,111,600 | B2 | 9/2006 | Naumann | |
| 7,188,595 | B2 * | 3/2007 | Hara | 123/90.16 |

FOREIGN PATENT DOCUMENTS

| | | | |
|---|---|---|---|
| JP | 07-063023 | A | 3/1995 |
| JP | 11-107725 | A | 4/1999 |
| WO | WO 01/75279 | A1 | 10/2001 |
| WO | WO 02/35067 | A1 | 5/2002 |

* cited by examiner

*Primary Examiner*—Ching Chang
(74) *Attorney, Agent, or Firm*—Foley & Lardner LLP

(57) ABSTRACT

A valve actuating link is provided for transmitting a combined movement of a drive cam on a cam shaft and a control cam on a control shaft to a valve pressing structure of an engine valve. The valve actuating link comprises a bearing portion that bears the control shaft, a hook-shaped lower portion that surrounds the cam shaft keeping a given space therebetween and a cam portion that repeatedly pushes the valve pressing structure to induce an open/close operation of the engine valve. Each of a plurality of engine valves has its own respective drive cam, control cam, valve actuating link and valve pressing structure.

28 Claims, 9 Drawing Sheets

200
27b
26
27a
27
27b
27
27a
5b
5b
5a
5a
5
6
15
6
15
14
14
7c
7c
3a
3a
7
7a
7
7a
3
3
24
30
24b
30a
24
24a
30
30a
24b
24a
34
34
37
38
35
36
34a
33
33
37
23
33a
38
38
19
23
37
19
18
20
38
37
20
21
17
17
22c
8
18
21
16
16a
22a
22
16b
22b
16
16a
8
22
22c
22a
22b
16b

VARIABLE VALVE ACTUATION DEVICE OF INTERNAL COMBUSTION ENGINE

CROSS-REFERENCE TO RELATED APPLICATION

This application is a continuation of application Ser. No. 11/213,916, filed Aug. 30, 2005, which is incorporated herein by reference.

BACKGROUND OF THE INVENTION

1. Field of the Invention

The present invention relates in general to variable valve actuation devices of an internal combustion engine, and more particularly to the variable valve actuation devices of a type that induces an open/close operation of engine valves (viz., intake and/or exhaust valves) while varying a lift degree of the engine valves in accordance with an operation condition of the engine.

2. Description of the Related Art

Hitherto, in the field of variable valve actuation devices of an internal combustion engine, various types have been proposed and put into practical use. Some of them are described in Japanese Laid-open Patent Applications (Tokkaihei) 7-63023 and 11-107725.

SUMMARY OF THE INVENTION

However, due to their inherent construction, the variable valve actuation devices disclosed by the above-mentioned publications fail to have a compact and simple construction. That is, in the device of the former publication, the layout of parts arranged on a cylinder head is complicated, and in the device of latter publication, the parts arranged on the cylinder head have a complicated construction. Of course, such complicated layout and construction of the parts inevitably bring about a higher cost of the variable valve actuation device that is manufactured.

Accordingly, an object of the present invention is to provide a variable valve actuation device of an internal combustion engine which is simple in construction, compact in size and economical.

In accordance with a first aspect of the present invention, there is provided a variable valve actuation device of an internal combustion engine, which comprises a cam shaft driven by a crankshaft of the engine, the cam shaft having a drive cam formed thereabout; a control shaft having a control cam formed thereabout, the control shaft changing its angular position in accordance with an operation condition of the engine; a valve actuating link including a bearing portion that bears the control shaft, a hook-shaped lower portion that surrounds the cam shaft keeping a given space therebetween and a cam portion that repeatedly pushes a valve pressing structure of an engine valve, the valve actuating link inducing an open/close operation of the engine valve when pivoting about a first imaginary pivot axis provided by the control shaft; a swing arm pivotal about a second imaginary pivot axis provided by the valve actuating link, the swing arm having a first end contacting the drive cam and a second end contacting the control cam; and a biasing member that biases the first end of the swing arm toward the drive cam and biases the second end of the swing arm toward the control cam, wherein when the angular position of the control shaft is changed, a valve lift degree of the engine valve is varied.

In accordance with a second aspect of the present invention, there is provided a variable valve actuating device of an internal combustion engine, which comprises a cam shaft driven by a crankshaft of the engine, the cam shaft having a drive cam formed thereabout; a valve actuating link having a cam portion that is movable between the cam shaft and a valve pressing structure of an engine valve, the valve actuating link inducing an open/close operation of the engine valve when the cam portion is pivoted about a first imaginary pivot axis; and a lift degree varying mechanism that transmits a torque from the drive cam to the valve actuating link to rock the valve actuating link and varies a traveling path of the valve actuating link thereby to vary the valve lift degree of the engine valve when the valve actuating link is applied with an external force.

In accordance with a third aspect of the present invention, there is provided a variable valve actuation device of an internal combustion engine, which comprises a cam shaft driven a crankshaft of the engine, the cam shaft having a drive cam formed thereabout; a valve actuating link including a hook-shaped lower portion that surrounds the cam shaft keeping a given space therebetween, the hook-shaped lower portion being contactable with a valve pressing structure of the engine valve thereby to induce an open/close operation of the engine valve; and a lift degree varying mechanism that transmits a torque from the drive cam to the valve actuating link to rock the valve actuating link and varies a traveling path of the valve actuating link thereby to vary the valve lift degree of the engine valve when the valve actuating link is applied with an external force.

Other objects and advantages of the present invention will become apparent from the following description when taken in conjunction with the accompanying drawings.

DETAILED DESCRIPTION OF THE EMBODIMENTS

In the following, two embodiments 100 and 200 of the present invention will be described with reference to the accompanying drawings.

For ease of understanding, various directional terms, such as right, left, upper, lower, rightward and the like are used in the description. However, such terms are to be understood with respect to only a drawing or drawings on which a corresponding part or portion is shown. Throughout the description, substantially same parts and portions are denoted by the same numerals.

Figure 1:
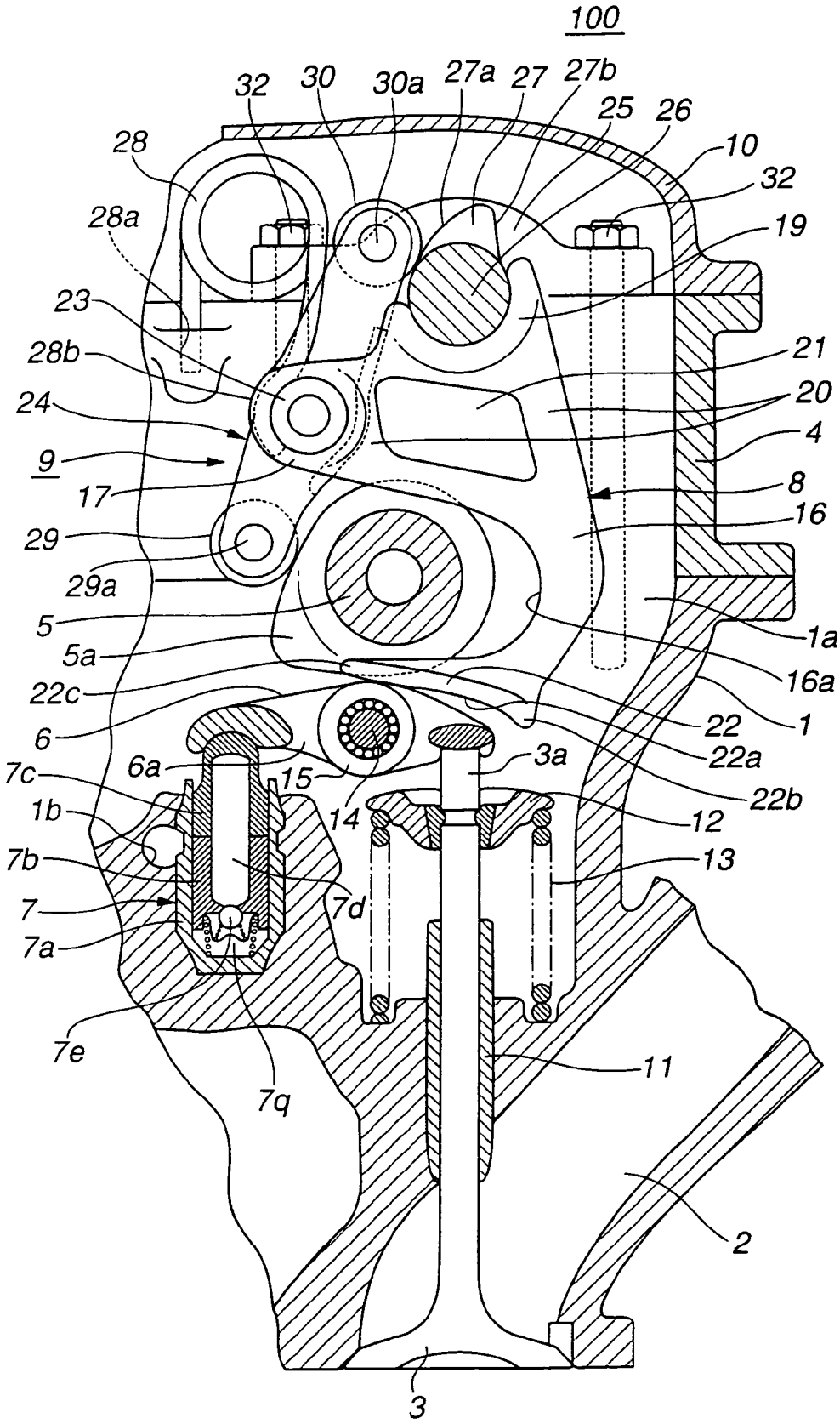
FIG. 1 is a sectional view of a variable valve actuation device which is a first embodiment of the present invention.

Referring to FIGS. 1 to 5, particularly FIG. 1, there is shown a variable valve actuation device 100 which is a first embodiment of the present invention.

As is understood from FIG. 1, an internal combustion engine to which variable valve actuation device 100 is practically applied is of a type that has a pair of intake ports 2 and 2 for each cylinder formed in a cylinder block (not shown). Each intake port 2 is provided with an intake valve 3 that is exposed to a combustion chamber defined in the cylinder above a corresponding piston (not shown).

Figure 3:
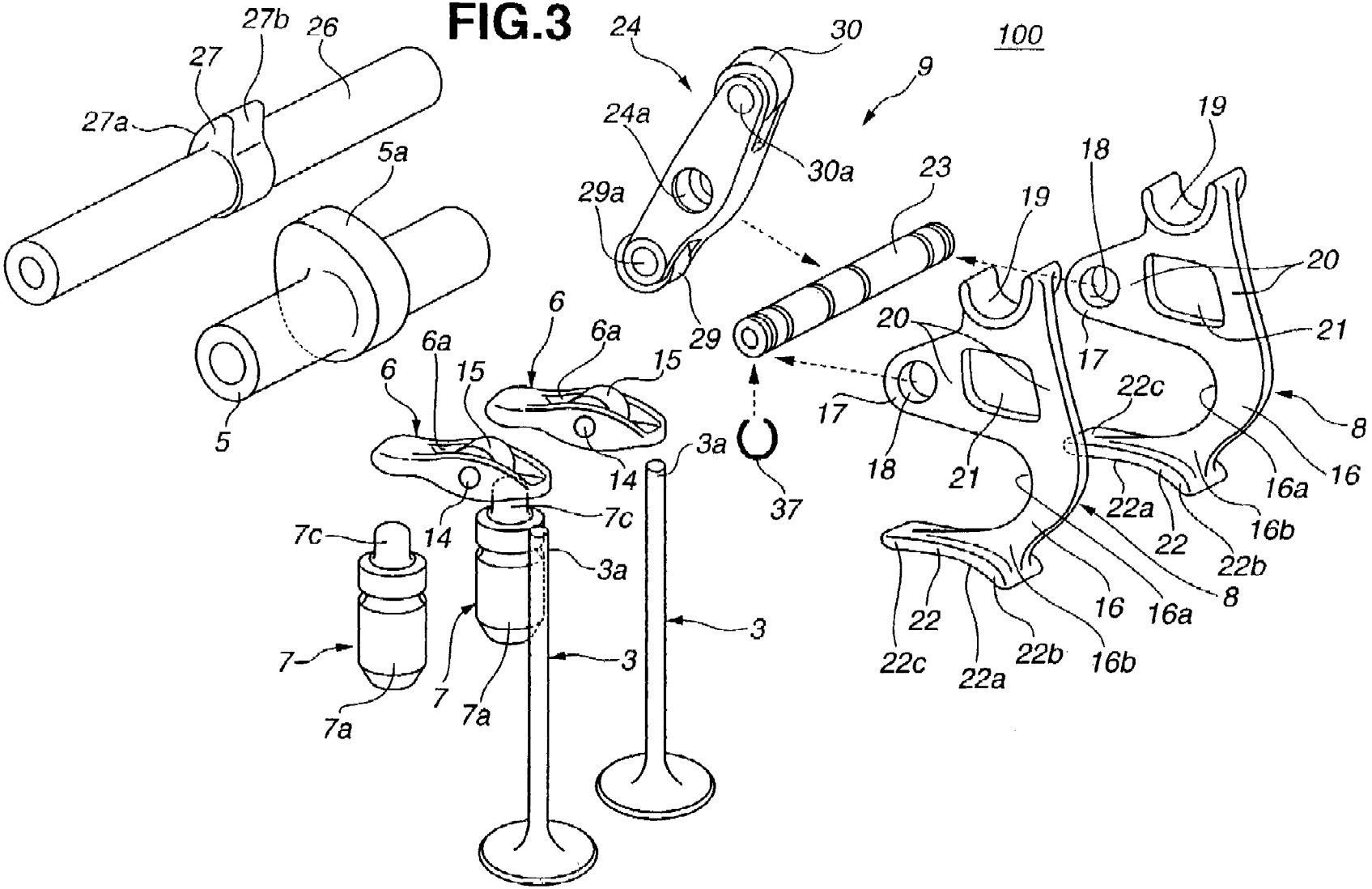
FIG. 3 is an exploded view of the variable valve actuation device of the first embodiment.

As will be understood from FIGS. 1 and 3, variable valve actuation device 100 comprises generally a cam shaft 5 that is rotatably supported on the cylinder head 1 through a bearing member 4 and extends along a longitudinal axis of the engine, two rocker arms 6 and 6 that have pressing arm portions contacting with stem ends 3*a* and 3*a* of intake valves 3 and 3, two hydraulic lash adjusters 7 and 7 that are held on cylinder head 1 and have heads or plungers 7*c* and 7*c* to which the other arm portions of rocker arms 6 and 6 contact, two valve actuating links 8 and 8 that are arranged to surround cam shaft 5 and induce open/close operation of intake valves 3 and 3 through rocker arms 6 and 6, and a lift degree varying mechanism 9 that varies a lift degree of intake valves 3 and 3 through valve actuating links 8 and 8. Denoted by numeral 10 is a head cover that is mounted on cylinder head 1.

As is seen from FIG. 1, each intake valve 3 is slidably held by a valve guide 11 set in cylinder head 1. As shown, each intake valve 3 is biased upward, that is, in a direction to close intake port 2 by a valve spring 13 that is arranged between a bottom of a recess formed in cylinder head 1 and a spring retainer 12 held by a stem of intake valve 3.

Figure 2:
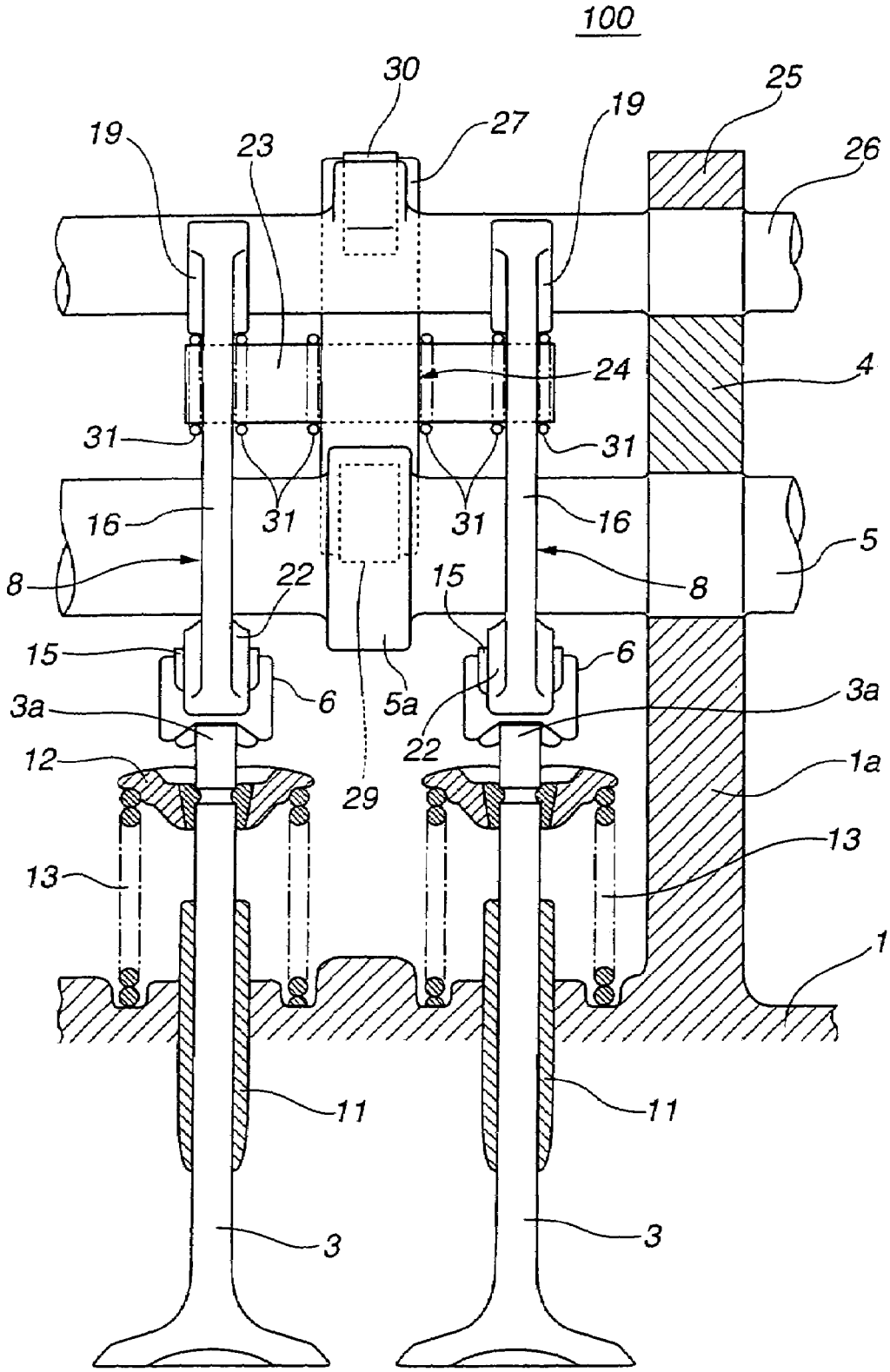
FIG. 2 is a partial front view of the variable valve actuation device of the first embodiment.

As will be understood from FIG. 2, cam shaft 5 is rotatably held by aligned circular bearing openings each comprising a semi-cylindrical groove that is formed on a raised block part 1*a* integrally formed on cylinder head 1 and another semi-cylindrical groove that is formed on a lower surface of bearing member 4.

As will be seen from FIGS. 2 and 3, cam shaft 5 is integrally formed with a drive cam 5*a* that has a lobe with a smoothed cam surface thereabout.

As is understood from FIGS. 1 and 3, each rocker arm 6 is formed with an aperture 6*a* that accommodates a roller 15. That is, roller 15 is rotatably held in aperture 6*a* through a roller shaft 14 that extends across aperture 6*a*. Although not shown in the drawings, a ball bearing is employed for smoothing rotation of roller 15 relative to roller shaft 14. One arm portion of each rocker arm 6 has a lower surface that is in contact with stem end 3*a* of the corresponding intake valve 3, and the other arm portion of rocker arm 6 has a concave lower surface that is in contact with a spherical head of plunger 7*c* of hydraulic lash adjuster 7.

Lash adjuster 7 is of a known type and as is seen from FIGS. 1 and 3, comprises a bottomed cylindrical body 7*a* that is tightly received in a cylindrical recess of cylinder head 1, a cylindrical retainer 7*b* that is tightly received in cylindrical body 7*a* and has an apertured lower part, and the above-mentioned plunger 7*c* that is axially slidably received in cylindrical body 7*a* above cylindrical retainer 7*b*. As shown, by and between cylindrical retainer 7*b* and plunger 7*c*, there is defined a hydraulic chamber 7*d*. A check valve 7*e* is pressed against a lower surface of the apertured lower part of cylindrical retainer 7*b* with a force of a biasing spring (no numeral). With this construction, a higher pressure chamber 7*q* is defined below the apertured lower part of cylindrical retainer 7*b*.

Into hydraulic chamber 7*d*, there is fed a hydraulic pressure through a hydraulic passage 1*b* formed in cylinder head 1.

When, under operation of the engine, plunger 7*c* is moved downward by the other arm portion of rocker arm 6, the hydraulic pressure in hydraulic chamber 7*d* is increased to a degree to open check valve 7*e* thereby to feed higher pressure chamber 7*q* with a hydraulic pressure. Upon this, plunger 7*c* is forced to move upward thereby to adjust a clearance between the one arm portion of rocker arm 6 and stem end 3*a* of the corresponding intake valve 3 to zero.

As is seen from FIGS. 2 and 3, two valve actuating links 8 and 8 are arranged to put therebetween drive cam 5*a* at their hook-shaped lower portions 16 and 16. That is, each hook-shaped lower portion 16 extends around cam shaft 6 leaving a certain space therebetween. As shown in FIG. 2, two valve actuating links 8 and 8 are arranged symmetric with respect to drive cam 5*a*.

As is best seen from FIGS. 1 and 3, valve actuating links 8 and 8 have each an arm portion 17 that extends toward lift degree varying mechanism 9 and has an opening 18 formed therethrough. Each valve actuating link 8 has at its top end a semi-cylindrical bearing recess 19.

As is understood from FIG. 3, hook-shaped lower portion 16 and semi-cylindrical bearing recess 19 are integrally connected through front and rear beam portions 20 between which a rectangular lightening opening 21 is formed. Provision of such lightening opening 21 brings about a reduced weight of valve actuating link 8.

Hook-shaped lower portion 16 has a concavely curved inner edge 16*a* that extends around the cylindrical outer surface of cam shaft 6 keeping a certain space therebetween and the hook-shaped lower portion 16 further has at its lower part a cam portion 22 that is slidably put on roller 15 of the corresponding rocker arm 6.

As is seen from FIG. 3, cam portion 22 of each valve actuating link 8 is generally rectangular in shape and has a slightly concaved lower surface or cam surface 22*a*. A base end 22*b* of cam portion 22 is integrally connected to a shank portion 16*b* of hook-shaped lower portion 16. Cam portion 22 is formed with a thinner front end 22*c*.

As is best seen from FIG. 3, cam surface 22*a* comprises generally a smaller radius curvature section located near base end 22*b* and a larger radius curvature section located near thinner front end 22*c*.

As is seen from FIGS. 1, 2, 3 and 4, semi-cylindrical bearing recesses 19 and 19 of valve actuating links 8 and 8 are used for rotatably supporting a control shaft 26 which will be described in detail hereinafter.

As is seen from FIGS. 1 and 3, lift degree varying mechanism 9 comprises a supporting shaft 23 (which corresponds to a second imaginary pivot axis) that has both ends received in openings 18 and 18 of the two valve actuating links 8 and 8, a swing arm 24 that is rotatably supported by supporting shaft 23, the above-mentioned control shaft 26 (which corresponds to a first imaginary pivot axis) that extends along the longitudinal axis of the engine, a control cam 27 that is integrally disposed on control shaft 26 at a position between the two valve actuating links 8 and 8, and a return spring 28 that is held by cylinder head 1 to bias swing arm 24 toward drive cam 5*a* and control cam 27.

As is seen from FIG. 3, supporting shaft 23 is a hollow shaft and has both ends rotatably received in openings 18 and 18. As is seen from FIG. 2, six C-rings 31 are employed for achieving relative positioning among supporting shaft 23, openings 18 and 18 and swing arm 24.

Referring back to FIG. 3, swing arm 24 is of a linear member and constructed of a pressed metal sheet. That is, swing arm 24 has a so-called channel structure for reducing the weight thereof. At a generally middle portion of swing arm 24, there is formed an opening 24*a* through which supporting shaft 23 passes. Swing arm 24 has at one end a first roller 29 rotatably connected thereto through a shaft 29*a* and at the other end a second roller 30 rotatably connected thereto through a shaft 30*a*.

As will be understood from FIGS. 1 and 3, first roller 29 is operatively put on the above-mentioned drive cam 5*a* and second roller 30 is operatively put on control cam 27.

As will be understood from FIG. 2, control shaft 26 is rotatably held by aligned circular bearing openings each comprising a semi-cylindrical groove that is formed on an upper surface of bearing member 4 and another semi-cylindrical groove that is formed on a lower surface of a bearing bracket 25, and control shaft 26 has axially spaced portions that are rotatably received in the above-mentioned semi-cylindrical bearing bearings 19 and 19 of valve actuating links 8 and 8. In other words, the axially spaced portions of control shaft 26 rotatably support valve actuating links 8 and 8.

As is seen from FIG. 3, control cam 27 on control shaft 26 has a lobe with a smoothed cam surface 27*a* and a depressed portion 27*b* thereabout.

As is seen from FIG. 1, the above-mentioned second roller 30 of swing arm 24 is pressed against smoothed cam surface 27*a* of control cam 27. As shown, both bearing bracket 25 and bearing member 4 are connected to the raised block parts 1*a* by a plurality of bolts and nuts 32.

Return spring 28 comprises a coiled middle portion, one end portion 28*a* that is press-fitted in a bore formed in an upper end of cylinder head 1 and the other end portion 28*b* that is curled to be pressed against supporting shaft 23, as shown in FIG. 1. Due to a biasing force of this return spring 28, first and second rollers 29 and 30 of swing arm 24 are pressed against drive cam 5*a* and control cam 27 respectively.

Although not shown in the drawings, an electric actuator turns control shaft 26 in one or other direction to a desired angular position in accordance with an operation condition of the engine. For controlling the electric actuator, a known control unit including a micro-computer is used. That is, by processing information signals from a crank angle sensor, a throttle angle sensor, an engine cooling water temperature sensor, an air flow meter and the like, the control unit judges a current engine operation condition and controls electric actuator in accordance with this judgment.

In the following, operation of variable valve actuation device 100 of the first embodiment will be described.

First, open/close movement of intake valves 3 and 3 will be described with reference to FIGS. 1 and 3.

A torque is transmitted from a crankshaft (not shown) of the engine to cam shaft 5 to turn the same. The torque of cam shaft 5 is then transmitted through drive cam 5*a* and first roller 29 to swing arm 24 to swing the same about supporting shaft 23. This swing movement or force of swing arm 24 is transmitted to valve actuating links 8 and 8 through supporting shaft 23.

Upon this, valve actuating links 8 and 8 are forced to swing about control shaft 26 causing cam portions 22 and 22 to intermittently press rollers 15 and 15 of rocker arms 6 and 6 against the biasing force of valve springs 13. Thus, intake valves 3 and 3 are opened and closed repeatedly. Cam surface 22*a* of each cam portion 22 runs on roller 15 between its base end 22*b* and its front end 22*c* for varying the lift degree of intake valves 3 and 3 as will be understood from the following description.

Second, lift degree control by lift degree varying mechanism 9 will be described with reference to FIGS. 1 and 3.

Under a low speed low load operation condition of the engine, such as, idling state of the engine, the control unit controls the electric actuator in a manner to turn control shaft 26 to a predetermined angular position. Upon this, as is seen from FIG. 4, cam surface 27*a* of control cam 27 contacts second rotor 30 at its slightly raised part.

Accordingly, swing arm 24 is forced to turn slightly in a clockwise direction about supporting shaft 23. Upon this, valve actuating links 8 and 8 are turned about control shaft 26 in a direction away from cam shaft 5, that is, in a counter-clockwise direction in FIG. 1, so that the position where cam surface 22*a* of each cam portion 22 and the corresponding roller 15 contacts moves from a generally center position of the cam surface 22*a* toward front end 22*c*.

Figure 6:
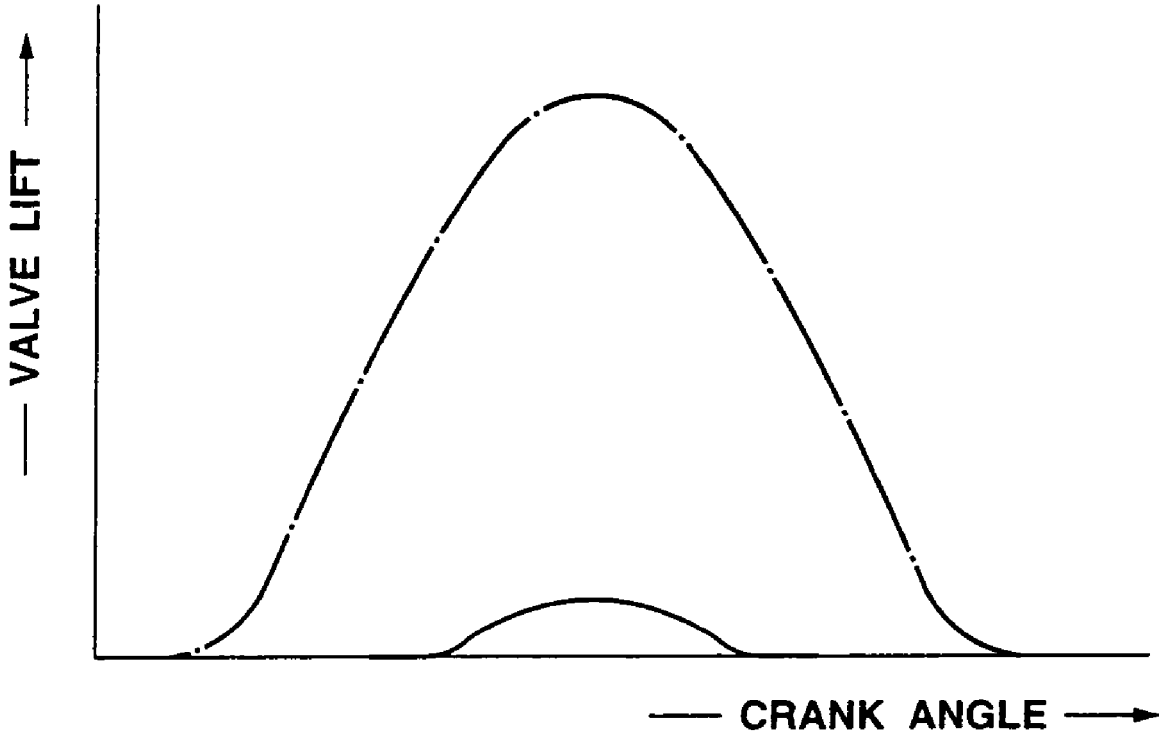
FIG. 6 is a graph showing a valve lift characteristic possessed by the variable valve actuation device of the first embodiment.

Accordingly, as is indicated by a solid line curve in FIG. 6, the lift degree of intake valves 3 and 3 is controlled small. As is known, when, under such low speed low load condition of the engine, the valve lift degree is controlled small, both improved fuel consumption and stability of engine operation are expected.

When thereafter the engine is shifted to a high speed high load operation condition, the control unit controls the electric actuator in a manner to turn control shaft 26 to another predetermined angular position. Upon this, as is seen from FIG. 5, cam surface 27*a* of control cam 27 contacts second rotor 30 at its highly raised part.

Accordingly, swing arm 24 is forced to turn in a counter-clockwise direction about supporting shaft 23 against the biasing force of return spring 28. Upon this, valve actuating links 8 and 8 are turned about control shaft 26 in a direction to near cam shaft 5, that is, in a clockwise direction in FIG. 5, so that the position where cam surface 22*a* of each cam portion 22 and the corresponding roller 15 contacts moves from the front end 22*c* toward the base end 22*b*.

Accordingly, as is indicated by a dot-dash line curve in FIG. 6, the lift degree of intake valves 3 and 3 is controlled high. With this, a high power is produced by the engine.

For assembling the variable valve actuation device 100, the following assembly steps are preferable.

As will be understood from FIGS. 1, 2 and 3, at first, cam shaft 5, control shaft 26, bearing member 4 and bearing bracket 25 are temporarily mounted on cylinder head 1 by loosely mating nuts 32 to bolts, and return spring 28 is fixed to cylinder head 1. Furthermore, actuating links 8 and 8, swing arm 24 and supporting shaft 23 are temporarily assembled to constitute a temporary unit.

Then, the temporary unit is brought to control shaft 26 from a lower position having the semi-cylindrical bearing recesses 19 and 19 thereof mated with control shaft 26, and then, the temporary unit is turned about control shaft 26 allowing hook-shaped lower portions 16 and 16 thereof to accommodate cam shaft 5 with a certain space therebetween. Then, nuts 32 on bolts are turned in a fastening direction. With this, the above-mentioned temporarily assembled units are mounted on cylinder head 1 in such a manner as is shown in FIG. 1.

Upon this mounting, swing arm 24 is biased rightward in FIG. 1 by return spring 28, so that first and second rollers 29 and 30 are resiliently pressed against drive cam 5*a* and control cam 27, and cam portions 22 and 22 of valve actuating links 8 and 8 are pressed against rollers 15 and 15 of rocker arms 6 and 6 from above position. Finally, nuts 32 and 32 are sufficiently turned in the fastening direction for completing the mounting of the parts onto cylinder head 1.

As is described hereinabove, valve actuating links 8 and 8, swing arm 24 and supporting shaft 23 can be temporarily assembled to constitute the temporary unit before being mounted on cylinder head 1. Furthermore, because of provision of the hook-shaped lower portions 16 and 16 that are shaped to surround cam shaft 5, the temporary unit can be brought to a right position in a cross section of cylinder head 1. Thus, mounting of the unit onto cylinder head 1 can be quickly made with a simple labor.

It is to be noted that provision of hook-shaped lower portions 16 and 16 of the valve actuating links 8 and 8 does not compel cam shaft 5 to change its position or layout. That is, in the variable valve actuation device 100, valve actuating links 8 and 8 can be set at their right positions relative to stem ends 3*a* and 3*a* of intake valves 3 and 3 without interfering with cam shaft 5, and thus, there is no need of considering change of layout of parts on cylinder head 1. In other words, in the variable valve actuation device 100, needed valve lift degree control is achieved by simply arranging valve actuating links 8 and 8 and lift degree varying mechanism 9 near cam shaft 5 in the above-mentioned manner.

In the following, other advantages of the variable valve actuation device 100 will be described in the following.

Valve actuating links 8 and 8 and lift degree varying mechanism 9 can be compactly arranged above cam shaft 5. This means that variable valve actuation device 100 can be easily applicable to internal combustion engines of a high power type that has intake and exhaust ports complicated in shape for increasing the engine power. That is, due to the compact arrangement of variable valve actuation device 100, there is no need of increasing the size of cylinder block 1 or complicating the structure of the same, which brings about reduction in cost of the engine.

Control shaft 26 serves as not only means for mounting thereon control cam 27 but also means for pivotally supporting valve actuating links 8 and 8. That is, there is no need of providing a separate support member that pivotally supports valve actuating links 8 and 8, which induces a simpler construction of the device 100.

Because of the unique cam surface 22*a* of cam portion 22 of each valve actuating link 8 as mentioned hereinabove, the biasing force of valve spring 13 that varies in accordance with the lift degree of intake valve 3 is smoothly applied to cam surface 22*a* from roller 15. Accordingly, undesired wearing of cam surface 22*a* is suppressed or at least minimized. Due to the thinner construction of front end 22*c* of cam portion 22, reduction in weight of valve actuating link 8 is achieved.

Figure 4:
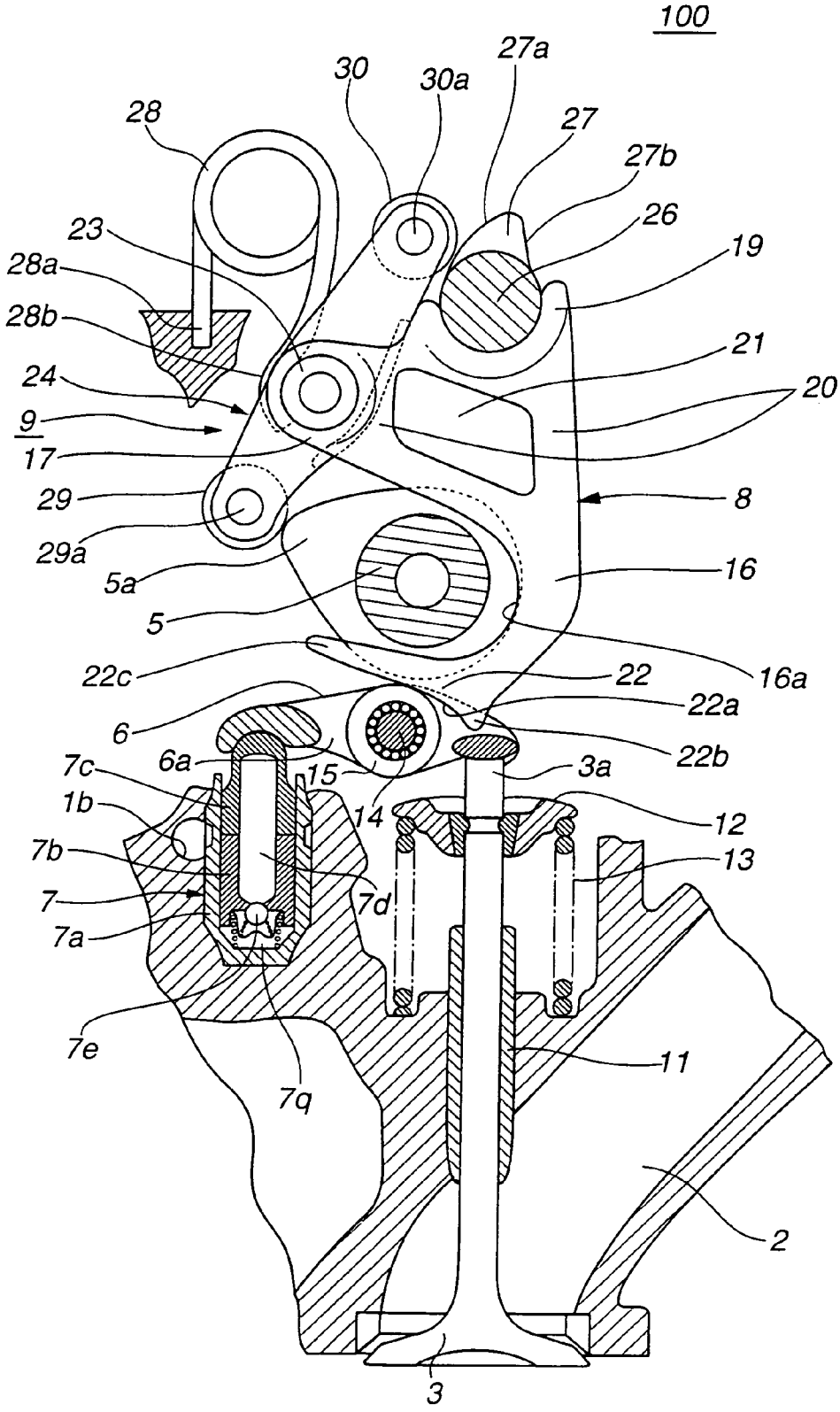
FIG. 4 is a view similar to FIG. 1, but showing a condition wherein the variable valve actuation device is under a smaller valve lift mode.
Figure 5:
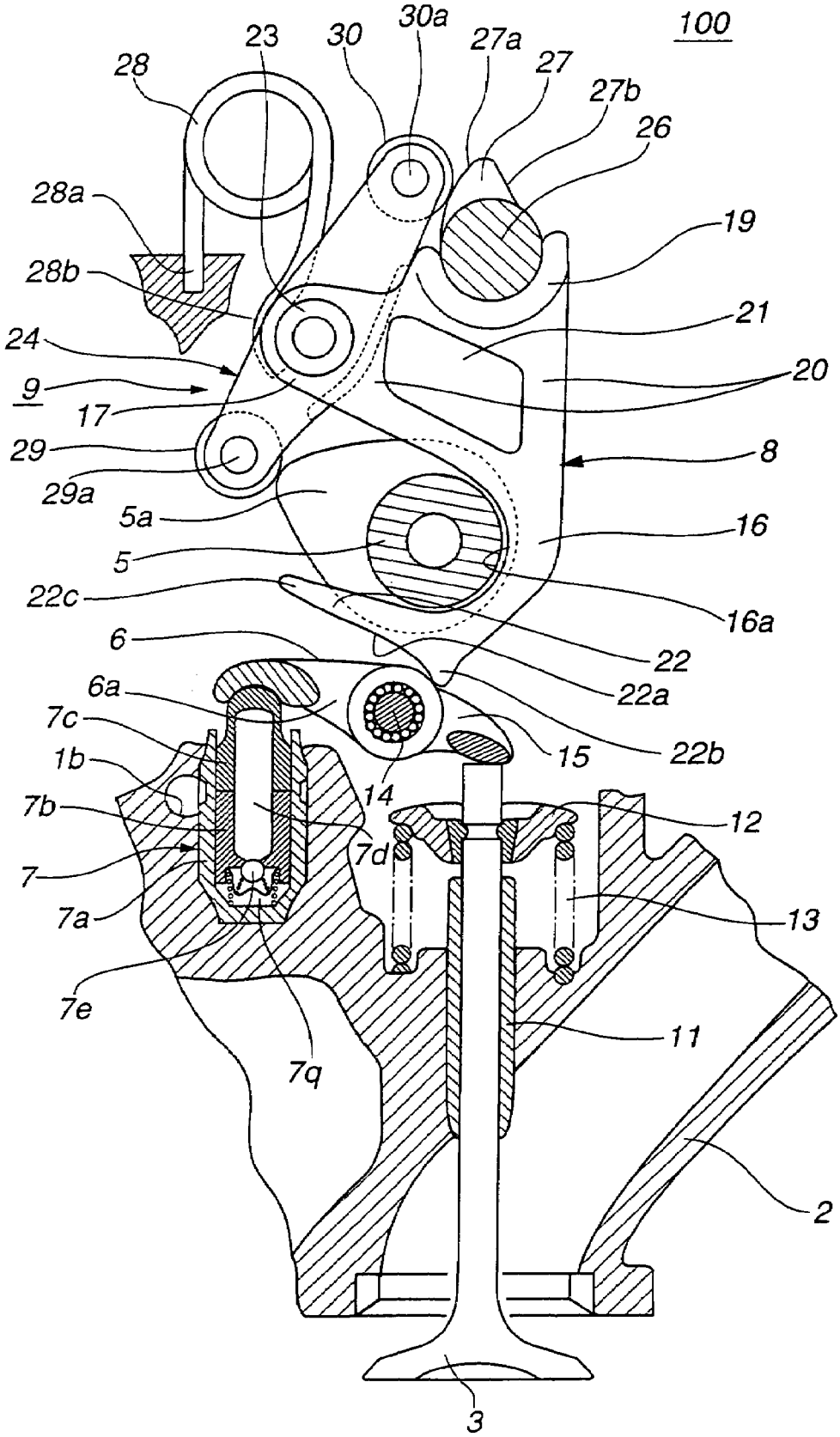
FIG. 5 is a view also similar to FIG. 1, but showing a condition wherein the variable valve actuation device is under a higher valve lift mode.

As will be understood from FIG. 4 or 5, when intake valve 3 is opened, that is, when cam portion 22 of valve actuating link 8 pushes down rocker arm 6 at its cam surface 22*a*, the biasing force produced by valve spring 13 is applied to control shaft 26 from a lower position from semi-cylindrical bearing recess 19 of valve actuating link 8 through rocker arm 6, roller 15, cam portion 22 and the major part of valve actuating link 8. Under this condition, cam shaft 5 keeps rotation, and thus, drive cam 5*a* of cam shaft 5 pushes first roller 29 incessantly inducing pivotal movement of swing arm 24. That is, when drive cam 5*a* pushes first roller 29, second roller 30 is pressed against control cam 27 in a direction to cancel the biasing force from valve spring 13. This prevents control shaft 26 from being applied with an excessive force. Accordingly, reduction in diameter and reduction in weight of control shaft 26 are obtained.

The two valve actuating links 8 and 8 are controlled by the single drive cam 5*a*, which induces a simpler construction of the device 100.

The two valve actuating links 8 and 8 are arranged symmetric with respect to drive cam 5*a*, and thus, the biasing forces of valve springs 13 and 13 of two intake valves 3 and 3 are evenly applied to the two valve actuating links 8 and 8. With this, undesired inclination of the two links 8 is suppressed, which increases the performance lift degree varying mechanism 9.

Due to usage of first and second rollers 29 and 30 on both ends of swing arm 24, frictions applied to drive cam 5*a* and control cam 27 are almost suppressed or at least minimized, which induces an increased durability of the device 100. Usage of semi-cylindrical bearing recesses 19 and 19 of two valve actuating links 8 and 8 facilitates assembling of the links 8 and 8 relative to control shaft 26. The biasing force of valve springs 13 is applied to control shaft 26 through semi-cylindrical bearing recesses 19 and 19, which induces reduction in friction of the bearing recesses 19 and 19.

Each valve actuating link 8 is forced to swing about an axis of control shaft 26. During the swinging, cam surface 22*a* of the link 8 describes a curve, and thus, the thinner front end 22*c* can produce an exact base circle for the zero lift condition of intake valve 3, which brings about an exact operation of hydraulic lash adjuster 7.

As is seen from FIG. 3, each valve actuating link 8 comprises semi-cylindrical bearing recess 19, front and rear beam portions 20, hook-shaped lower portion 16 and cam portion 22 which are compactly united. The compact construction and provision of opening 21 induce a light weight and robust construction of the link 8.

For biasing and pressing both first and second rollers 29 and 30 of swing arm 24 against drive cam 5*a* and control cam 27 respectively, only one return spring 28 is used, which induces a simple construction of the device 100.

As is seen from FIG. 1, the curled end portion 28*b* of return spring 28 is resiliently and intimately pressed against the cylindrical outer surface of supporting shaft 23. Accordingly, even when the attitude of swing arm 24 is changed, the pressed contact of the curled end portion 28*b* to supporting shaft 23 is kept unchanged, and thus, the biasing force applied to swing arm 24 from return spring 28 is constantly stable.

Figure 7:
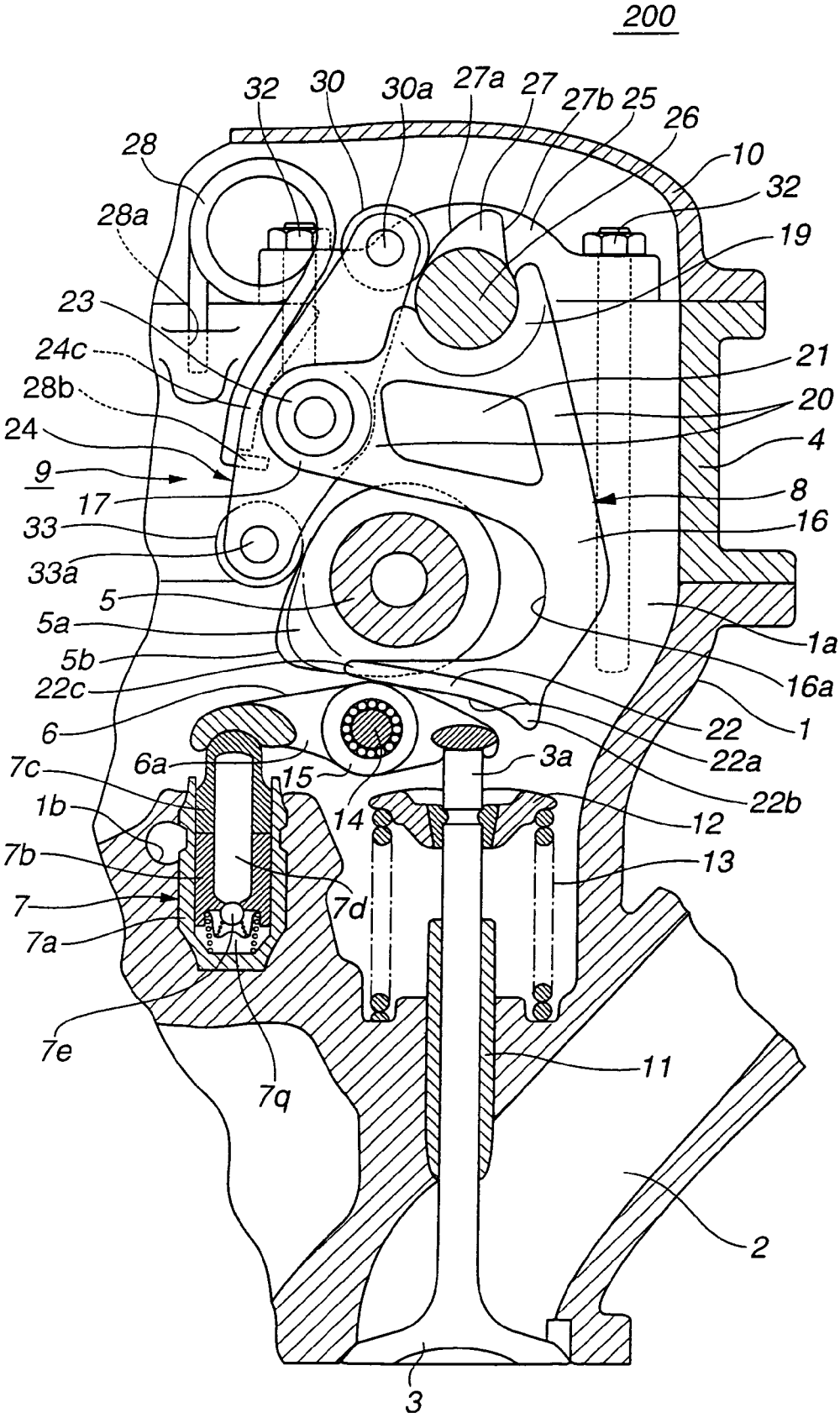
FIG. 7 is a view similar to FIG. 1, but showing a variable valve actuation device which is a second embodiment of the present invention.
Figure 8:
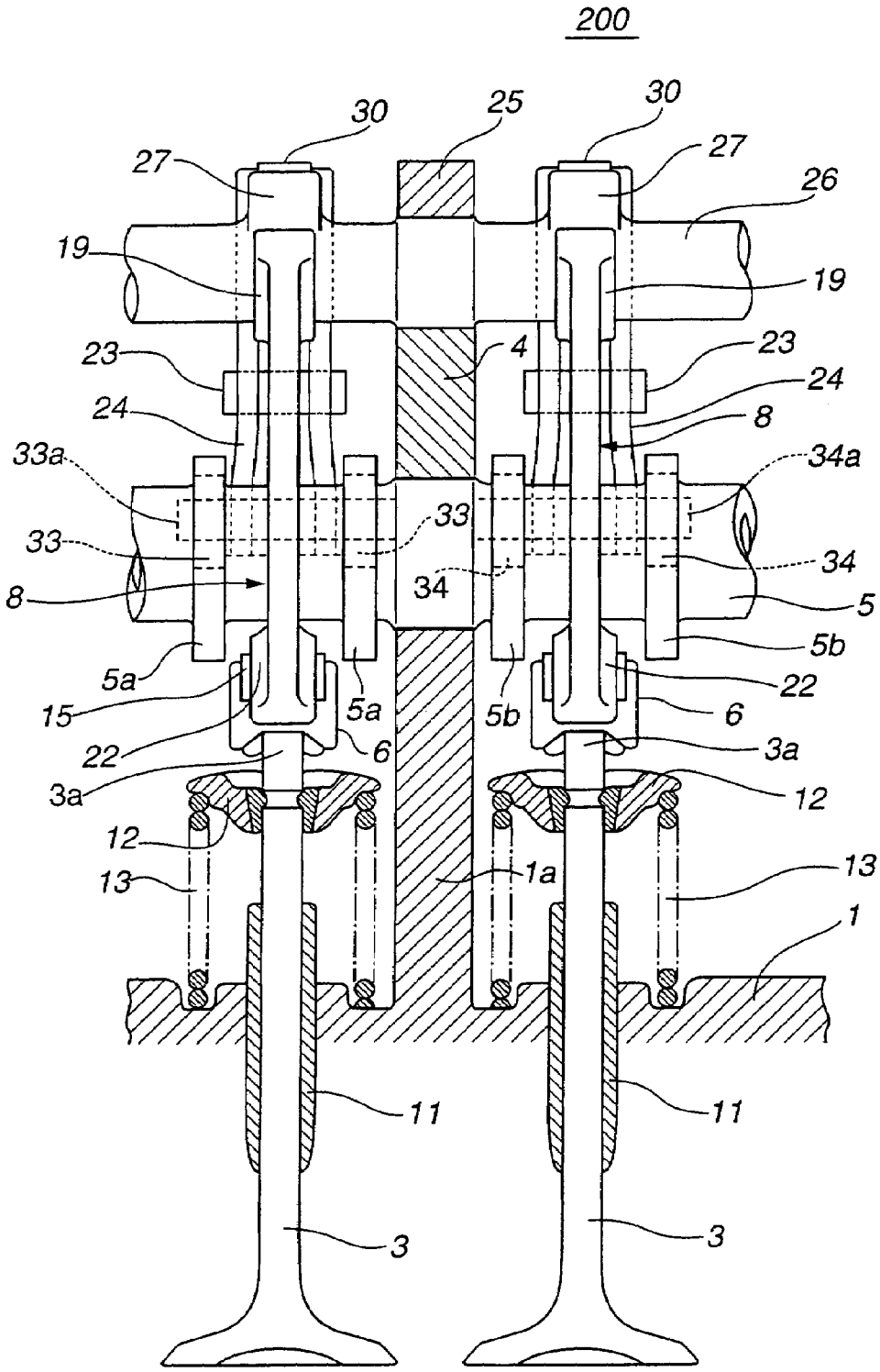
FIG. 8 is a partial front view of the variable valve actuation device of the second embodiment.
Figure 9:
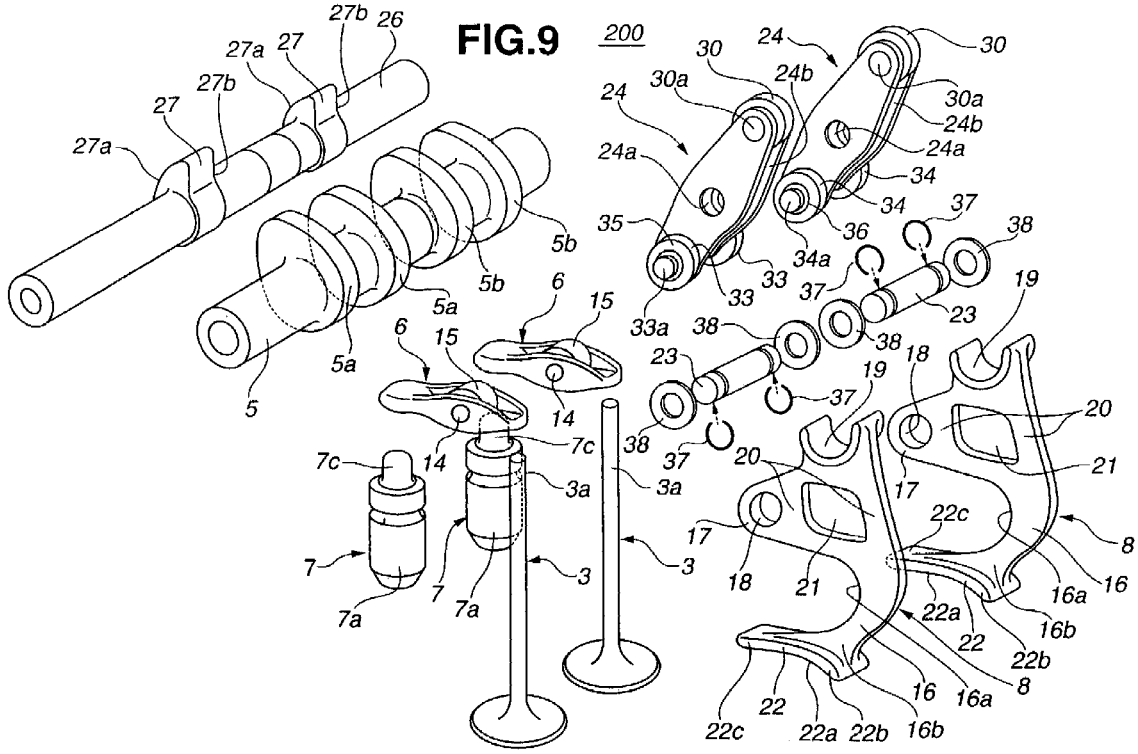
FIG. 9 is an exploded view of the variable valve actuation device of the second embodiment.

Referring to FIGS. 7 to 9 of the drawings, there is shown a variable valve actuation device 200 which is a second embodiment of the present invention.

In this second embodiment 200, two valve actuating systems are employed for respectively or independently actuating the two intake valves 3 and 3. That is, the two intake valves 3 and 3 are respectively controlled by two swing arms 24 and 24.

As is seen from FIG. 9, two pairs of drive cams 5*a* and 5*a* (and 5*b* and 5*b*) are integrally formed on cam shaft 5, and two control cams 27 and 27 are integrally formed on control shaft 26. In the illustrated embodiment, the cam profile of drive cams 5*a* and 5*a* is different from that of the other drive cams 5*b* and 5*b*, and the cam profile of one control cam 27 is different from that of the other control cam 27.

As is seen from FIG. 8, between the paired drive cams 5*a* and 5*a* and the other paired drive cams 5*b* and 5*b*, and between the two control cams 27 and 27, there is arranged a supporting wall structure that bears cam shaft 5 and control shaft 26. The supporting structure includes one raised block part 1*a* of cylinder head 1, bearing member 4 and bearing bracket 25.

Each valve actuating system generally comprises one pair of drive cams 5*a* and 5*a* (or 5*b* and 5*b*), one control cam 27, one swing arm 24, one valve actuating link 8, one rocker arm 6 and one lash adjuster 7.

In the following, the detail of each valve actuating system will be described with reference to FIG. 9.

For the reason that will become apparent hereinafter, swing arm 24 is constructed to have an elongate slit 24*b* that is sized to receive arm portion 17 of the corresponding valve actuating link 8. For providing swing arm 24 with such elongate slit 24*b*, it is preferable to produce swing arm 24 of channel structure by pressing a metal sheet.

As shown, swing arm 24 is formed at a generally middle portion thereof with an opening 24*a* through which supporting shaft 23 passes. Swing arm 24 is provided at its lower end with two first rollers 33 and 33 (or 34 and 34) that are rotatably connected thereto through respective shafts 33*a* (or 34*a*), and at its upper end with a second roller 30 that is rotatably connected thereto through a shaft 30*a*. Washers 35 and 36 are employed for holding first rollers 33 and 34 in position.

It is to be noted that upon assembly, two first rollers 33 and 33 (or 34 and 34) are respectively put on the two drive cams 5*a* and 5*a* (or 5*b* and 5*b*) of cam shaft 5, and second roller 30 (or 30) is put on control cam 27 (or 27) of control shaft 26.

As is understood from FIGS. 8 and 9, supporting shaft 23 is rotatably received at its generally middle portion in opening 18 of valve actuating link 8. Washers 38 and C-rings 37 are employed for holding supporting shaft 23 in position.

Mounting swing arm 24 to valve actuating link 8 is carried out in the following assembling steps.

First, swing arm 24 is put on valve actuating link 8 in a manner to receive arm portion 17 of the link 8 in the slit 24*a*. Then, swing arm 24 is slightly moved relative to the link 8 to achieve an aligned arrangement between the openings 24*a* and 18, and then supporting shaft 23 is inserted into the aligned openings 24*a* and 18, and then, washers 38 and C-rings 37 are connected to opposed ends of supporting shaft 23.

As is seen from FIG. 7, the end portion 28*b* of return spring 28 is bent at right angles to have an elongate press portion 24*c* by which back sides 24*c* of the two swing arms 24 are pressed toward cam shaft 5 and control shaft 26.

Accordingly, in this second embodiment 200, basic operation of valve actuating links 8 and 8 and that of lift degree varying mechanism 9 are substantially the same as those of the above-mentioned first embodiment 100.

However, as is described hereinabove, in the second embodiment 200, the open/close operation of the two intake valves 3 and 3 is independently controlled by the respective actuating systems each generally including paired drive cams 5*a* and 5*a* (or 5*b* and 5*b*) of cam shaft 5, one control cam 27 (or 27) of control shaft 26, one swing arm 24, one valve actuating link 8, one rocker 6 and one lash adjuster 7. For biasing the two swing arms 24 and 24 in a given direction, a single return spring 28 is employed.

Accordingly, in the second embodiment 200, transmission of movement of drive cams 5*a*, 5*a*, 5*b* and 5*b* and that of control cams 27 and 27 to intake valves 3 and 3 are much assuredly and precisely carried out as compared with the above-mentioned first embodiment 100.

As is seen from FIG. 8, drive cams 5*a*, 5*a*, 5*b* and 5*b* are positioned near rocker arms 6 and 6. This means that positioning of cam shaft 5 on cylinder head 1 is easily made without making a large change in layout of parts on conventional cylinder head.

As is described hereinabove, the cam profiles of one pair of drive cams 5*a* and 5*a* are different from those of the other pair of drive cams 5*b* and 5*b*. This enhances a swirl phenomenon of air/fuel mixture fed into a combustion chamber in the cylinder, which brings about not only improvement in fuel consumption but also improvement in exhaust emission.

Since, as is seen from FIG. 8, the valve actuating systems are operatively supported by the supporting wall structure (1*a*, 4 and 25) in a balanced way, the loads applied to the swing arms 24 and 24 from cam shaft 5 and control shaft 26 are effectively transmitted to valve actuating links 8 and 8 and thus to the two intake valves 3 and 3, which brings about a stable open/close operation of the intake valves 3 and 3.

Each swing arm 24 is constructed to have the slit 24*b* to receive therein arm portion 17 of valve actuating link 8, which brings about a compact unit that includes link 8, swing arm 24 and supporting shaft 23. If swing arm 24 is constructed by pressing a metal plate, cost reduction of the unit is achieved.

The entire contents of Japanese Patent Application 2004-252257 filed Aug. 31, 2004 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A variable valve actuating device of an internal combustion engine, comprising:

a cam shaft driven by a crankshaft of the engine, the cam shaft having drive cams formed thereabout, each drive cam associated with and actuating a respective one of a plurality of engine valves;

a control shaft having control cams formed thereabout, each control cam associated with a respective one of said plurality of engine valves, the control shaft changing angular position about its longitudinal axis in accordance with an operating condition of the engine;

a plurality of valve actuating links, each valve actuating link associated with a respective one of said plurality of engine valves and having a bearing portion that bears against the control shaft so as to be swingable about the axis of the control shaft and a cam portion that is movable in a space defined between the cam shaft and a valve pressing structure of the respective engine valve to engage the valve pressing structure and induce an open/close operation of the respective engine valve when the valve actuating link is swung about the axis of the control shaft;

a plurality of swing arms, each swing arm associated with a respective one of said plurality of engine valves and pivoted to the respective valve actuating link, a first end of the swing arm contacting the respective drive cam and a second end of the swing arm contacting the respective control cam; and a plurality of biasing members, each biasing member associated with a respective one of said plurality of engine valves, biasing the first end of the respective swing arm toward the respective drive cam and biasing the second end of the respective swing arm toward the respective control cam, whereby a change in the angular position of the control shaft changes the angular position of the control cams, which varies the degree of lift of said plurality of engine valves.

2. A variable valve actuating device as claimed in claim 1, wherein a lower portion of each valve actuating link is where the cam portion is located and is shaped like a hook.

3. A variable valve actuating device as claimed in claim 2, wherein the hook-shaped lower portion of the valve actuating link extends around and is spaced from the camshaft.

4. A variable valve actuating device as claimed in claim 1, wherein each swing arm has an elongate slit sized to receive a portion of the respective valve actuating link.

5. A variable valve actuating device as claimed in claim 4, wherein the portion of the valve actuating link that is received in the elongate slit is pivotally connected to the swing arm.

6. A variable valve actuating device as claimed in claim 1, wherein a portion of each valve actuating link between the control shaft and the cam portion is pivotally connected to the respective swing arm.

7. A variable valve actuating device as claimed in claim 1, wherein the first end of each swing arm is equipped with a first roller that contacts the respective drive cam, and the second end of each swing arm is equipped with a second roller that contacts the respective control cam.

8. A variable valve actuating device as claimed in claim 1, wherein the bearing portion of each valve actuating link comprises an arcuate bearing recess which engages the control shaft.

9. A variable valve actuating device as claimed in claim 8, wherein the valve actuating link is biased toward the axis of the control shaft by a biasing means through the arcuate bearing recess.

10. A variable valve actuating device as claimed in claim 1, wherein a portion of each valve actuating link between the control shaft and the cam portion is substantially flat with a lightening opening therethrough.

11. A variable valve actuating device as claimed in claim 1, wherein the cam portion of each valve actuating link is shaped from a base end thereof toward a leading end thereof to gradually reduce the valve lift degree of the respective engine valve when moving on the valve pressing structure of the engine valve.

12. A variable valve actuating device as claimed in claim 1, wherein the cam shaft and said plurality of engine valves are supported on a cylinder head of the engine, the variable valve actuating device actuating two valves of each cylinder of the cylinder head.

13. A variable valve actuating device of an internal combustion engine, comprising:

a cam shaft driven by a crankshaft of the engine, the cam shaft having drive cams formed thereabout, each drive cam associated with and actuating a respective one of a plurality of engine valves;

a plurality of valve actuating links, each valve actuating link associated with a respective one of said plurality of engine valves and having a cam portion that is swingably movable in a space defined between the cam shaft and a valve pressing structure of the respective engine valve to engage the valve pressing structure and induce an open/close operation of the respective engine valve, the cam portion being swingable about a first imaginary axis which is located at a position opposite to the engine valve with respect to the cam shaft; and a lift degree varying mechanism that transmits torque from the drive cams to the valve actuating links to rock the valve actuating links, and varies the traveling paths of the valve actuating links to vary the valve lift degree of the engine valves, the lift degree varying mechanism including a plurality of swing arms, each swing arm associated with a respective engine valve and swung by the respective drive cam to induce the swinging movement of the cam portion of the respective valve actuating link.

14. A variable valve actuating device as claimed in claim 13, wherein a lower portion of each valve actuating link is where the cam portion is located and is shaped like a hook.

15. A variable valve actuating device as claimed in claim 14, wherein the hook-shaped lower portion of the valve actuating link extends around and is spaced from the camshaft.

16. A variable valve actuating device as claimed in claim 13, wherein each swing arm has an elongate slit sized to receive a portion of the respective valve actuating link.

17. A variable valve actuating device as claimed in claim 16, wherein the portion of the valve actuating link that is received in the elongate slit is pivotally connected to the swing arm.

18. A variable valve actuating device as claimed in claim 13, wherein a portion of each valve actuating link between the first imaginary axis and the cam portion is pivotally connected to the respective swing arm.

19. A variable valve actuating device as claimed in claim 18, wherein the valve actuating link is pivotally connected to a middle portion of the respective swing arm, a first end of the swing arm is swung by the respective drive cam, and a second end of the swing arm is adjustably positioned in accordance with an operating condition of the engine to vary the valve lift degree of the respective engine valve.

20. A variable valve actuating device as claimed in claim 19, wherein the first end of the swing arm is equipped with a first roller that contacts the respective drive cam.

21. A variable valve actuating device as claimed in claim 13, wherein the cam shaft and said plurality of engine valves are supported on a cylinder head of the engine, the variable valve actuating device actuating two valves of each cylinder of the cylinder head.

22. A variable valve actuating device of an internal combustion engine, comprising:

a cam shaft driven by a crankshaft of the engine, the cam shaft having drive cams formed thereabout, each drive cam associated with and actuating a respective one of a plurality of engine valves;

a plurality of valve actuating links, each valve actuating link associated with a respective one of said plurality of engine valves and having a hook-shaped lower portion that extends around and is spaced from the cam shaft, the hook-shaped lower portion having a cam portion that is swingably movable in a space defined between the cam shaft and a valve pressing structure of the respective engine valve to engage the valve pressing structure and induce an open/close operation of the respective engine valve; and a lift degree varying mechanism that transmits torque from the drive cams to the valve actuating links to rock the valve actuating links, and varies the traveling paths of the valve actuating links to vary the valve lift degree of the engine valves, the lift degree varying mechanism including a plurality of swing arms, each swing arm associated with a respective engine valve and swung by the respective drive cam to induce the swinging movement of the cam portion of the respective valve actuating link.

23. A variable valve actuating device as claimed in claim 22, wherein each swing arm has an elongate slit sized to receive a portion of the respective valve actuating link.

24. A variable valve actuating device as claimed in claim 23, wherein the portion of the valve actuating link that is received in the elongate slit is pivotally connected to the swing arm.

25. A variable valve actuating device as claimed in claim 22, wherein each valve actuating link is pivotally connected to the respective swing arm.

26. A variable valve actuating device as claimed in claim 25, wherein the valve actuating link is pivotally connected to a middle portion of the respective swing arm, a first end of the swing arm is swung by the respective drive cam, and a second end of the swing arm is adjustably positioned in accordance with an operating condition of the engine to vary the valve lift degree of the respective engine valve.

27. A variable valve actuating device as claimed in claim 26, wherein the first end of the swing arm is equipped with a first roller that contacts the respective drive cam.

28. A variable valve actuating device as claimed in claim 22, wherein the cam shaft and said plurality of engine valves are supported on a cylinder head of the engine, the variable valve actuating device actuating two valves of each cylinder of the cylinder head.

* * * * *